United States Patent [19]

Shimazaki

[11] Patent Number: 4,926,922

[45] Date of Patent: May 22, 1990

[54] CURTAIN DRAWING DEVICE

[75] Inventor: Fumio Shimazaki, Osaka, Japan

[73] Assignee: Topia Industry Co., Ltd., Higashiosaka, Japan

[21] Appl. No.: 277,841

[22] Filed: Nov. 30, 1988

[30] Foreign Application Priority Data

Dec. 4, 1987 [JP] Japan ..... 62-305956
Aug. 8, 1988 [JP] Japan ..... 63-196037

[51] Int. Cl.[5] ..... A47H 5/06

[52] U.S. Cl. ..... 160/331; 160/343; 160/349.1

[58] Field of Search ..... 160/331, 343, 349.2, 160/349.1, 330, 123, 126; 292/144

[56] References Cited

U.S. PATENT DOCUMENTS

| | | | |
|---|---|---|---|
| 1,339,353 | 5/1920 | Kimber | 160/343 |
| 1,954,941 | 4/1934 | Monnier | 160/343 |
| 2,251,512 | 8/1941 | Bush et al. | 160/349.2 X |
| 2,256,008 | 9/1941 | Armstrong | 160/331 |
| 2,616,499 | 11/1952 | Eckles | 160/343 X |
| 2,846,079 | 8/1958 | Leeper | 160/343 |
| 3,003,552 | 10/1961 | Eilenberger | 160/343 X |
| 3,208,507 | 9/1965 | Breen | 160/343 |
| 3,774,665 | 11/1973 | Bourne | 160/343 |
| 4,023,609 | 5/1977 | Rosenguist | 160/343 |
| 4,343,344 | 8/1982 | Shelton | 160/349.2 |
| 4,832,104 | 5/1989 | De Labarthe et al. | 160/343 |

*Primary Examiner*—David M. Purol
*Attorney, Agent, or Firm*—Michael J. Striker

[57] ABSTRACT

TYhe curtain drawing device providing either manual or automatic drawing of a curtain comprises an electric motor, a curtain rod which is driven rotatably by the motor, an exteriorly-protruding longitudinally-extending spiral element attached to the outer circumference of the curtain rod and a plurality of rings through which the curtain rod passes, each of which have a diameter larger than the diameter of the curtain rod, so that the curtain which is suspended from the rings can be drawn manually or by rotation of the curtain rod. An automatically-releasing tassel holder which can be operated by remote control may be provided.

4 Claims, 4 Drawing Sheets

FIG. 1
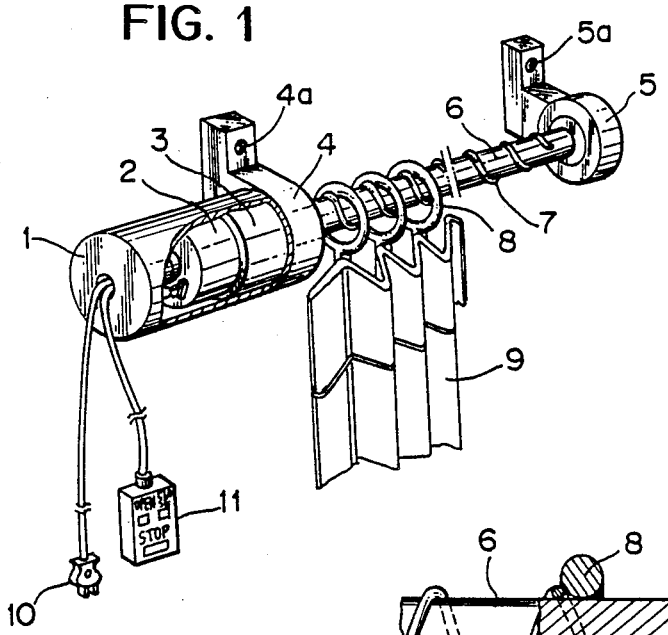
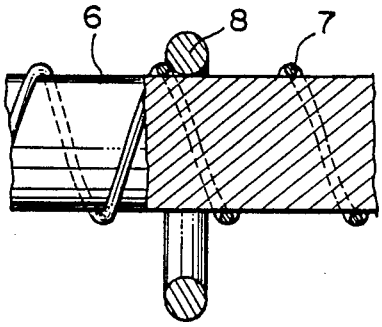
FIG. 2
FIG. 3
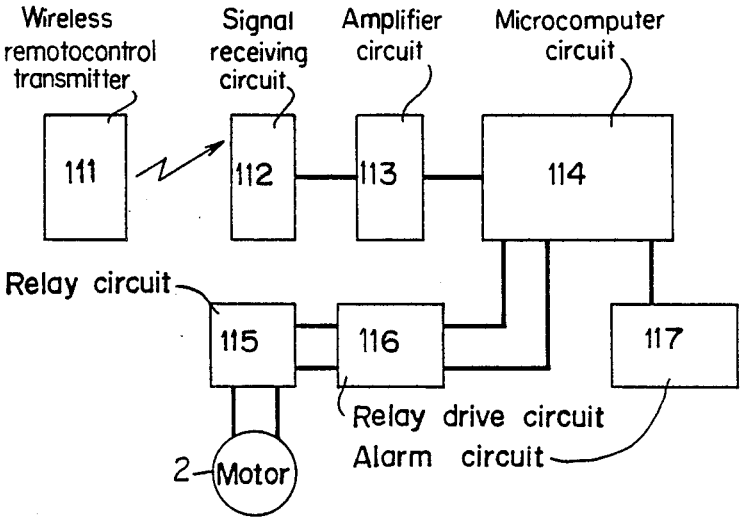

CURTAIN DRAWING DEVICE

BACKGROUND OF THE INVENTION

The present invention relates to a curtain drawing device which is both manually and automatically operable by remote control.

In existing curtain drawing devices a wire is often used to connect an electric motor and a curtain directly, so that the motor is sometimes subject to an excess load, and the curtain cannot be drawn by hand.

It is inconvenient when a man at a remote location wishes to draw the curtain if a remote controlled automatically operable curtain drawing device is not available. In electric curtain drawing devices now on market, the electric motor and the curtain are connected with a wire, and these types of devices cannot be used to draw a curtain by hand. So, if the electric motor gets out of order, the curtain could not be moved.

Curtains are often bundled by tassel bands. If the existing automatic curtain drawing device is used to draw the curtain, the tassel band must be released by hand first to carry out the automatic release operation. Especially with remote control, the merits of an automatic device cannot be utilized to the maximum extent.

This invention has been designed to remove shortcomings involved with the prior art.

SUMMARY OF THE INVENTION

It is an object of the invention to provide a simple and easily-operated curtain drawing device, which is operable either manually or automatically.

It is another object of the invention to provide an automatic tassel releasing device to release the tassel band and draw the curtain.

It is a further object of the invention to provide a mechanism for a curtain drawing device which does not put excess load on the motor when the curtain has been drawn.

In keeping with these and other objects, the curtain drawing device comprises a curtain rod driven and directly connected to an electric motor having an exteriorly-protruding spiral element extending over a substantial portion of its length encircling the rod and a plurality of rings through which the curtain rod passes each of which have an inner diameter larger than the outer diameter of the curtain rod. When the drawing of the curtain is finished, the rings run idle on the rod so that the motor is not effected with overload as it would, if the curtain drawing device are connected with a wire to the curtain.

A tassel for holding the curtain may be engaged in an automatically-releasing tassel holder. On receiving an electrical signal a solenoid of the tassel holder may be activated to release the tassel so that the curtain can be drawn.

BRIEF DESCRIPTION OF THE DRAWING

FIG. 1 is a perspective view of a main portion of an electric curtain drawing device according to the invention;

FIG. 2 is a side view, partially in section, showing the relation between a curtain rod and a ring of the electric curtain drawing device;

FIGS. 3 and 4 are block diagrams of electric circuitry for the curtain drawing device;

DETAILED DESCRIPTION OF THE INVENTION

Figure 4:
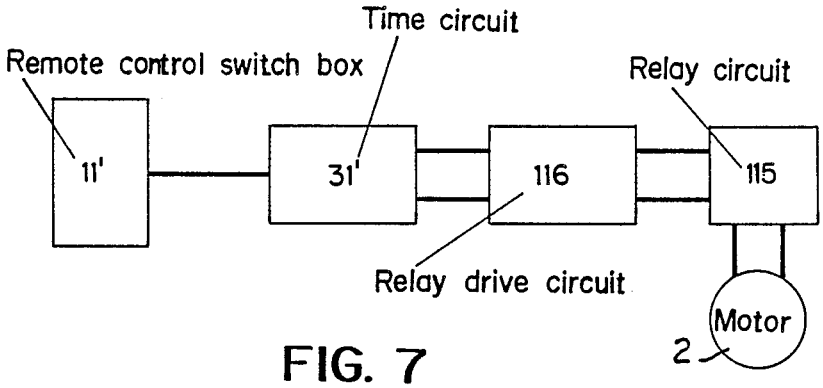

The embodiment of the curtain drawing device includes a cover 1, an electric motor 2, a motor-connected reduction gear 3, bearings 4, 5 and a curtain rod 6.

The output shaft of the reduction gear 3 is connected to the curtain rod 6. The rotation of the motor 2 is reduced by the reduction gear 3 to rotate the rod 6. The reduction gear 3 is secured to the housing of the bearing 4. The bearings 4 and 5 are fixed to the window frame by screws 4*a* and 5*a*. The curtain rod 6 is rotatably mounted in bearings 4 and 5.

An exteriorly-protruding spiral element 7 formed by a spiral winding of several turns is provided on the outer circumference of the curtain rod 6. A plurality of rings 8 are positioned on the rod 6, each ring between individual turns of the spiral element 7. The ring 8 has a circular transverse cross-section. Its inner diameter is larger than the outer diameter of the rod 6 including the spiral element 7, so that the ring 8 may be manually moved over the spiral element 7, which may be made of a resilient material. Further the thickness of the ring 8 is greater than the height of the spiral element 7.

A curtain 9 is suspended from the rings 8. The curtain 9 can be manually moved along the rod 6 by simply grasping it and pulling it in the direction of the rod 6.

A plug 10 and cord for the electric motor are provided. A switch box 11 for automatic operation or drawing of the curtain is provided.

FIG. 3 shows a block diagram of electric circuitry for wireless remote control operation of the curtain drawing device. This circuitry comprises a microcomputer circuit 114 for controlling operations connected to an alarm circuit 117, a relay circuit 115 directly connected to the motor 2 which is interfaced to the microcomputer circuit 114 with a relay drive circuit 116. The microcomputer circuit 114 receives a remote signal from a wireless remote control transmitter 111 via a signal receiving circuit 112.

FIG. 4 also shows a different embodiment and amplifier circuit 113 in which a remote switch 111 activates the curtain drawing.

FIGS. 5 to 8 and 9 show an additional feature of the invention, an automatically-releasing tassel holder 16 for a tassel band 12 which ties back the curtain 9. The tassel band 12 has a first hook 13 on one end and a second hook 13' on another end. The first hook 13 engages on a ring 14 connected with a fixing pin 15. The second hook 13' is engaged or caught on a fixed retaining pin 22. A solenoid 17 is incorporated in a tassel holder 16 and has a movable central shaft 19 in a hole provided therein which is urged or biased toward the lower part of the tassel holder 16 by a spring 18. The fixing pin 15 is inserted in a fixing pin receptacle 21 and secured by the movable shaft 19. The movable shaft 19 is biased upwardly by an external electric signal passing through the solenoid 17 and then the fixing pin 15 slides out on an appropriate course from receptacle 20 under its own weight. Then the curtain 9 is released from the tassel band 12.

Figure 7:
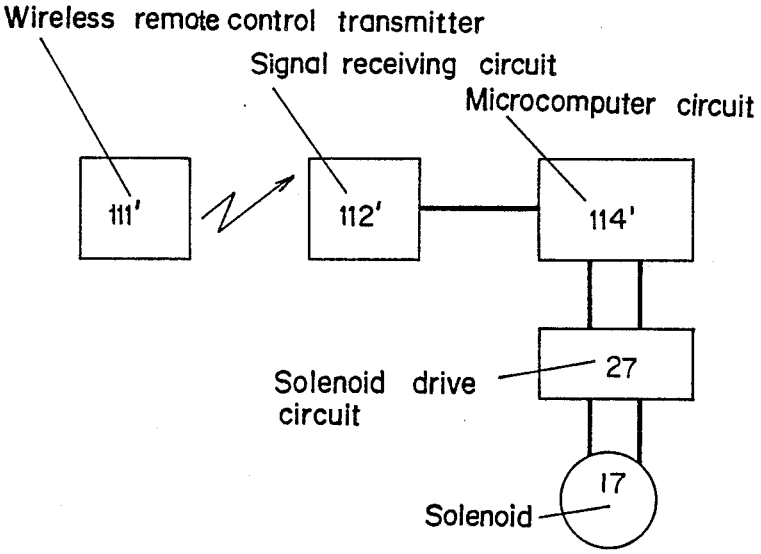
FIGS. 7 and 8 are block diagrams of the electric circuits.
Figure 8:
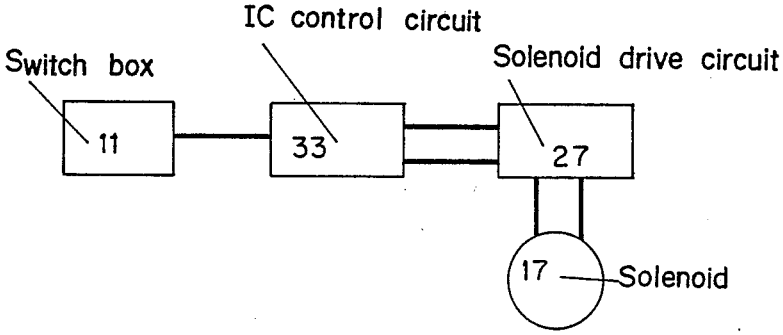
Figure 5:
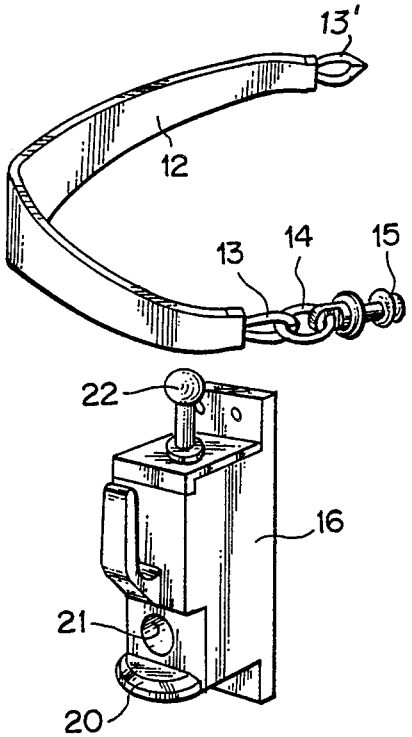
FIG. 5 is a perspective view of an automatically releasing tassel holder of a curtain tassel band.
Figure 6:
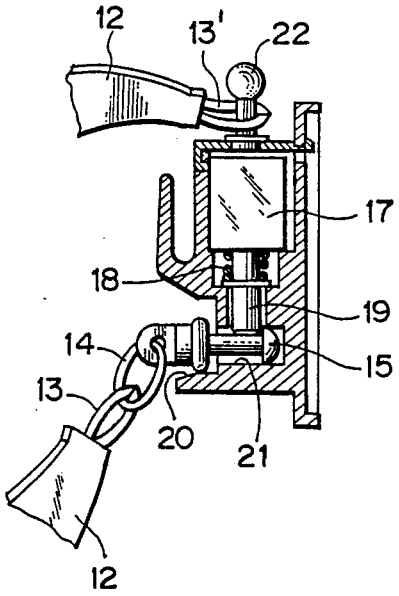
FIG. 6 is a detailed side view, partially in crosssection, showing the closed or connected state of the tassel release mechanism of the above device.

FIGS. 7 and 8 show appropriate electric circuitry for actuating the tassel band release mechanism. A wireless remote control circuit is shown in FIG. 7. Similar to the mechanism of FIG. 3 a wireless remote control transmitter 111' sends a signal to a signal receiving circuit 112' connected to a microcomputer circuit 114'. The solenoid is interfaced to the microcomputer circuit 114' by a solenoid drive circuit 27.

In the example of FIG. 8 a simple switch box 11 contains a switch for activating an IC control circuit 33 for energizing a solenoid drive circuit 27 of a solenoid 17.

Figure 9:
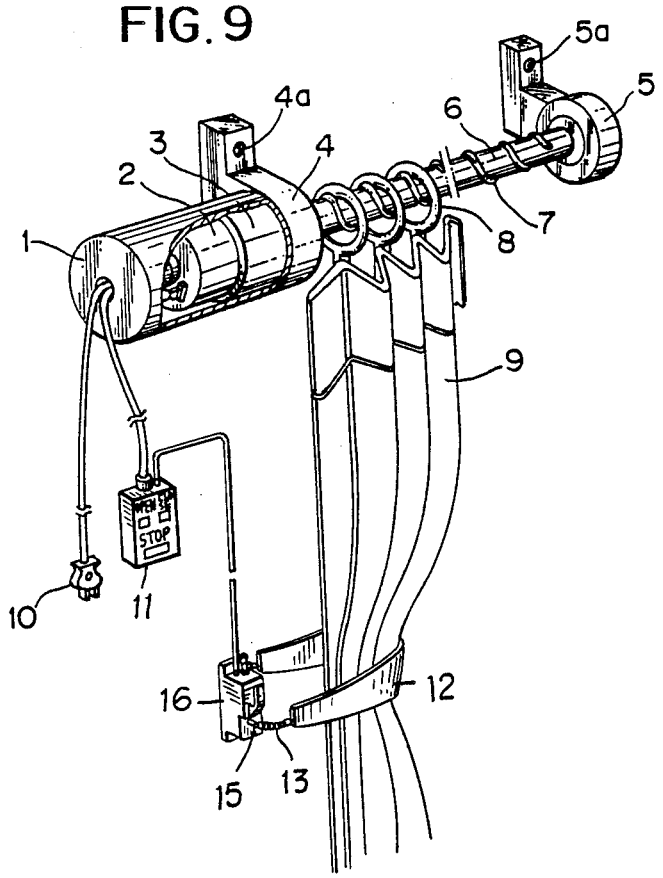
FIG. 9 is a perspective view of a curtain suspended from the curtain drawing device tied back by a tassel band held by an automatically-releasing tassel holder.

In operation, first the solenoid 17 is activated releasing the tassel 12 and freeing the curtain 9 shown tied in FIG. 9 so that it can be drawn. Then the motor 2 is activated by remote control using the circuitry of FIG. 3, for example. The motor 2 rotates the curtain rod 6 at a reduced speed by reduction gear 3. The rings 8 are moved longitudinally as a result by abutting against the spiral element 7 until the curtain 9 abuts against a stop or ring 8 reaches bearing 5. Then the rings 8 run idle until the motor 3 is turned off. No excessive load is thus put on motor 3.

We claim:

1. A curtain drawing device for a curtain providing either manual or automatic drawing of said curtain comprising:

an electric motor;

a curtain rod, which is rotatably mounted and connected to said electric motor so that said electric motor can drive said curtain rod rotatably;

an exteriorly-protruding longitudinally-extending spiral element attached to an outer circumference of said curtain rod, said spiral element encircling said curtain rod;

a plurality of rings, through which said curtain rod passes, each of said rings having a larger diameter than a diameter of said curtain rod including said spiral element, said curtain being attachable to said rings for suspension from said curtain rod, and a tassel band and a solenoid-actuated tassel holder, which holds one end of said tassel band and which is structured to release said tassel band when said solenoid-actuated tassel holder receives an external electrical signal.

2. A curtain drawing device for a curtain providing either manual or automatic drawing of said curtain comprising:

an electric motor;

a curtain rod, which is rotatably mounted and connected to said electric motor so that said electric motor can drive said curtain rod rotatably;

an exteriorly-protruding longitudinally-extending spiral element attached to an outer circumference of said curtain rod, said spiral element encircling said curtain rod;

a plurality of rings, through which said curtain rod passes, each of said rings having a larger diameter than a diameter of said curtain rod including said spiral element, said curtain being attachable to said rings for suspension from said curtain rod, and a tassel band having a first and a second hook at each end of said tassel band and a tassel holder comprising a receptacle and a retaining pin on which said second hook is caught, a fixing pin with a connected ring on which said first hook is engagable, said fixing pin being securable but slidable in said receptacle of said tassel holder, and an exteriorly-actuated solenoid surrounding a movable shaft extending in a hole provided in said tassel holder; said movable shaft being engageable in said fixing pin to secure said fixing pin to hold said fixing pin in said receptacle, said movable shaft being biased downwardly to engage said fixing pin by a spring and being biased upwardly to release said fixing pin and said curtain on energizing said solenoid.

3. The curtain drawing device according to claim 2 further comprising a microcomputer circuit controlled by a wireless remote control device and actuating said solenoid.

4. The curtain drawing device according to claim 2 further comprising a solenoid drive circuit and associated switch for actuating said solenoid.

* * * * *